US010927862B2

(12) United States Patent
Bueter

(10) Patent No.: US 10,927,862 B2
(45) Date of Patent: Feb. 23, 2021

(54) DOUBLE-ACTING OVERFLOW VALVE OF A WORKING CYLINDER AND MASTER CYLINDER

(71) Applicants: BÜMACH ENGINEERING INTERNATIONAL B.V., Ta Emmen (NL); Josef Bueter, Haren/Altenberge (DE)

(72) Inventor: Josef Bueter, Haren/Altenberge (DE)

(73) Assignee: Buemach Engineering International B.V., Emmen (NL)

( * ) Notice: Subject to any disclaimer, the term of this patent is extended or adjusted under 35 U.S.C. 154(b) by 0 days.

(21) Appl. No.: 16/496,536

(22) PCT Filed: Mar. 2, 2018

(86) PCT No.: PCT/DE2018/000050
§ 371 (c)(1),
(2) Date: Sep. 23, 2019

(87) PCT Pub. No.: WO2018/171824
PCT Pub. Date: Sep. 27, 2018

(65) Prior Publication Data

US 2020/0378412 A1 Dec. 3, 2020

(30) Foreign Application Priority Data

Mar. 23, 2017 (DE) ..... 20 2017 001 547 U

(51) Int. Cl.
*F15B 15/20* (2006.01)
*F15B 15/22* (2006.01)

(52) U.S. Cl.
CPC ..... *F15B 15/204* (2013.01); *F15B 15/225* (2013.01)

(58) Field of Classification Search
CPC ..... F15B 15/204; F15B 15/225; F16K 15/18
See application file for complete search history.

(56) References Cited

U.S. PATENT DOCUMENTS 4,326,449 A * 4/1982 Perraud ..... F15B 15/225 91/401
4,478,129 A 10/1984 Hannes et al.
(Continued)

FOREIGN PATENT DOCUMENTS

DE 2643109 A1 3/1978
DE 3330670 A1 3/1985
(Continued)

*Primary Examiner* — Thomas E Lazo
(74) *Attorney, Agent, or Firm* — Laurence A. Greenberg; Werner H. Stemer; Ralph E. Locher

(57) ABSTRACT

A double-acting overflow valve of a working cylinder includes a housing with an encompassing wall and a first and a second axial delimiting wall disposed opposite one another. A first valve body has a first valve tappet with a conical shape and passes through the first axial bore to define a first annular gap with a gap width that is dependent on a position of the first valve body along an actuation path thereof. A second valve body has a second valve tappet with a conical shape and passes through the second axial bore to a second annular gap with a gap width that is dependent on a position of the second valve body along an actuation path thereof. A first and second counter bearing are provided. A first actuating element defines a maximum actuation path of the first valve body by acting on the first counter bearing. A second actuating element defines a maximum actuation path of the second valve body by acting on the second counter bearing. A first spring applies an axial force to the first valve body in a direction of the closed position of the first valve disk. A second spring applies an axial force to the second valve body in a direction of the closed position of the second valve disk.

5 Claims, 2 Drawing Sheets

(56) References Cited

U.S. PATENT DOCUMENTS

| | | | | |
|---|---|---|---|---|
| 4,633,665 | A | 1/1987 | Bueter et al. | |
| 4,729,283 | A * | 3/1988 | Hillier | F15B 15/1447 137/614.11 |
| 7,739,941 | B2 * | 6/2010 | Noble | F15B 11/15 91/363 R |
| 8,850,952 | B2 * | 10/2014 | Albrecht | F01L 21/04 91/401 |
| 9,890,802 | B2 * | 2/2018 | Albrecht | F16K 15/06 |
| 10,746,202 | B2 * | 8/2020 | Tetrick | F15B 20/007 |

FOREIGN PATENT DOCUMENTS

| | | | |
|---|---|---|---|
| DE | 202004011532 | U1 | 9/2004 |
| DE | 102004044832 | B3 | 1/2006 |
| EP | 0142787 | A2 | 5/1985 |

* cited by examiner

DOUBLE-ACTING OVERFLOW VALVE OF A WORKING CYLINDER AND MASTER CYLINDER

BACKGROUND OF THE INVENTION

Field of the Invention

The invention relates to a double-acting overflow valve of a working cylinder, in particular for use in a master-slave working cylinder system, and a master cylinder.

From the state of the art, valves are known for controlling fluid flows between adjacent chambers with different pressures which have a sealing element in an interior on which external force is applied and thus the flow between the inlet and outlet can be controlled.

Valves of this type can be used in working cylinders to achieve pressure compensation between adjacent piston chambers or so-called pressure accumulators in order to continuously compensate pressure losses and leaks.

The publication DE 20 2004 011 532 U1 describes a valve in the chamber of which an elastic molded body with pretension is arranged as a blocking element. In order to exert an axial force on the blocking element, a tappet to be mechanically actuated from the outside is provided at least on one side of the valve. This solution is simple and cost-effective in terms of design, although the blocking element made of an elastomer must withstand high mechanical loads during a long-term use of the valve.

In addition, publication DE 10 2004 044 832 B3 discloses a backflow preventer which has an inlet port, an outlet port and a leakage port positioned between them. Two check valves and a movable valve body are also provided. A bypass duct, which bypasses the two check valves, at least partially transfers an excess pressure existing in the outlet opening to the area of the inlet opening.

Furthermore, a valve which is arranged in the piston unit of a hydraulic cylinder is known from publication EP 01 42 787 A2. The valve is opened by a front-side stop of the axially arranged tappets provided on both sides against the inner surfaces of the closure parts of the hydraulic cylinder.

However, a serious disadvantage of the technical solutions known so far is that the flow volume of the fluid existing in the inlet and outlet, which determines the pressure compensation between the adjacent piston chambers, is always constant or cannot be controlled at least. Moreover, the different pressures prevailing in the piston chambers and the flow volume existing in the inlet and outlet can also lead to undesired dynamic pressures in the interior of the valve.

SUMMARY OF THE INVENTION

Therefore, it is the task of the invention to provide a double-acting overflow valve of a working cylinder, which allows a pressure-dependent control of the flow volume of the fluid, which ensures a permanent and reliable sealing of the inlet and outlet, and which is cost-efficient and easy to construct. Furthermore, it is the task of the invention to disclose a master cylinder which makes a pressure-dependent controllable overflow of the fluid possible.

The task is solved by the features described in independent claim. Preferred further embodiments result from the dependent claims.

A double-acting overflow valve of a working cylinder according to the invention has a housing, a first valve element, a second valve element, a first counter bearing, a second counter bearing, and a first spring element and a second spring element.

The housing has an encompassing wall, a first and a second axial delimiting wall wherein the walls are arranged opposite each other. The encompassing wall and the delimiting walls form an interior. Thus, the preferred basic design is a hollow cylinder closed at the base and top.

The first axial delimiting wall has a first axial bore. On the interior, the first axial delimiting wall forms a first annular valve bearing surface which surrounds the first axial bore. In addition, the second axial delimiting wall has a corresponding second axial bore and forms a second annular valve bearing surface on the interior which surrounds the second axial bore. Thus, the two axial bores are holes which penetrate the delimiting walls and function, according to the invention, as an inlet and outlet for the flow fluid. Depending on the direction of operation, each of the bore holes can function both as an inlet to the interior and as an outlet from the interior.

The first valve element has a first valve tappet, a first valve disk and a first actuation path limiter. Preferably, the first valve element is designed as a one-piece component, in particular as a turning part. The first valve element is arranged such that it can be moved axially.

The first valve tappet has a first valve tappet head and a first valve tappet foot, which are located at the respective axial ends. The first tappet foot of the first valve tappet rests on the first valve disk. The first valve tappet passes through the first axial bore and has a conical shape, wherein the diameter of the first valve tappet increases from the first valve tappet head toward the first valve tappet foot.

In an open position of the overflow valve, the first valve tappet and the first axial bore form a first annular gap. For assuming the open position, the first valve element moves axially in the direction of the interior, and due to the conicity of the first valve tappet the width of the first annular gap increases during the continuous move toward the interior. Therefore, the gap width is not constant but depends on an actuation path of the first valve element so that different degrees of opening can be achieved. For this reason, the actuation path of the first valve element is also a measure of the amount of fluid flowing into or out of the interior of the overflow valve.

The first valve disk has a first axial annular surface which surrounds the first valve tappet foot. In a closed position, the first axial annular surface forms a sealing plane through contact with the first annular valve bearing surface of the first axial delimiting wall. Thus, a fluid flow into the overflow valve or out of it is prevented in the closed position. In addition, the first valve tappet foot rests against the inner wall of the first axial bore in the closed position so that an annular gap is not formed between the first valve tappet and the first axial bore.

Another component of the first valve element is the first actuation path limiter which rests on the first valve disk. According to the invention, the first actuation path limiter is arranged axially opposite the first valve tappet. The actuation path limiter has a first actuating element. In addition to the actuating element, the actuation path limiter can also comprise other components, in particular a carrier element which carries the actuating element. Preferably, the carrier element can be a pin and the actuating element a bush, wherein in such a design the pin rests on the first valve disk and the bush is carried by the pin. According to the invention, the actuating element is the adjustable element of the actuation path limiter, wherein different adjustment possibilities can be provided, e.g. by interchangeable actuating elements of different dimensions.

The actuating element defines a maximum actuation path of the first valve element by acting on the first counter bearing.

The exact design of the first counter bearing is not restricted in this design. The first counter bearing is provided as a stationary component arranged in the interior of the overflow valve, which can, for example, be designed as a partition wall the opposite side of which simultaneously forms the second counter bearing. In particular, the counter bearings and the housing together can be designed as a single component.

The foregoing explanations for the first valve element apply accordingly to the design and functionality of the second valve element. Thus, the second valve element comprises a second valve tappet, a second valve disk and a second actuation path limiter structured analogously to the first valve element.

However, whereas the basic structure of the two valve elements is identical according to the invention, changes in details can be made, particularly with regard to the size of the valve elements, the conicity of the valve tappets and the resulting actuation path, in order to allow the adaptation to the individual general conditions.

Moreover, two spring elements are provided as components of the double-acting overflow valve according to the invention. The first spring element is used to apply an axial force to the first valve element in the direction of its closed position, whereas the second spring element applies an axial force to the second valve element in the direction of its closed position. That means that the forces are applied in the direction of the axial delimiting walls. Thus, the spring elements are tensioned in the opening position of the valve elements and released in the closed position.

The spring elements are not restricted to a special design. In addition to a design of the two spring elements as compression springs made of spring steel, it is also possible to use molded bodies made of an elastic material.

Rubber springs with different spring characteristics are known, which are adapted to the individual application by selecting the appropriate spring rate.

In the case of application in a master-slave arrangement, the basic function of the double-acting overflow valve, hereinafter abbreviated as overflow valve, corresponds to the following overview of the functional description. The overflow valve is arranged in the piston or also in the piston rod and has access to the operating pressure of the system on the side leading to the pressure retaining piston chamber of the master cylinder. In the functional description, this side is called the first valve side.

The opposite second valve side is connected to the piston chamber of the slave cylinder via the main connection of the master cylinder, which is switched as an outlet, and for the purpose of the compensating flow, in consequence of loss flows in the slave cylinder, it is capable of providing an overflow by the double-acting valve via the opening of this valve side mechanically caused in the end position of the extended master cylinder.

In detail, the following applies additionally: The overflow valve is arranged such that its one side is pressure-connected to the piston chamber and its other side to the piston rod chamber. The side with the first axial bore, also known as the first valve side, faces the piston chamber and the side with the second axial bore, also known as the second valve side, faces the piston rod chamber. The description is based on the example of the operating condition in which the piston chamber is subject to excess pressure, hereinafter also referred to as the pressure retaining side. The piston is positioned on the guide closure part and thus in the end position where the piston rod is maximally extended.

On both sides of the overflow valve, an axial displacement of the respective valve elements can cause the opening of the respective valve side and thus allowing a fluid to flow into or out of the interior of the valve. The degree of opening of the respective valve side can be adjusted in dependence on the pressure. The adjustment is carried out by exchanging the relevant actuating elements or, if the actuating elements are designed as axially adjustable thread bushes, by their axial adjustment by means of a screw connection, e.g. on an inner pin of the relevant actuation path limiter.

When the valve elements are axially displaced in the direction of the open position, the sealing plane previously formed between the axial annular surface of the valve disk and the valve bearing surface of the delimiting wall in the closed position is removed. The displacement of the valve elements and thus the opening of the respective valve side is effected by the hydraulic operating pressure on the pressure retaining side, and on the valve side serving as the outlet the displacement is effected by a mechanical force acting as a result of the front face contact of the valve tappet at a closing part of the working cylinder. In the example explained, the first valve element is actuated by the hydraulic operating pressure and the second valve element is actuated mechanically by the second valve tappet.

The fluid quantity depends on the width of the annular gap between the axial bore and the valve tappet and can therefore be controlled by means of the actuation path. Consequently, the opening position can exist in different opening degrees, wherein the desired opening degree of the second valve side is fixed by the actuation path through the stop of the second valve tappet. In contrast, the opening degree of the first valve side depends on the pressure of the fluid.

Furthermore, the opening degree of the first valve side is determined by the actuation path, wherein the maximum actuation path is determined by the first actuation path limiter. The maximum overflowing fluid volume per time unit can be pre-set by the constructive determination of the actuation path by means of the actuating element.

Considering this, the actuation path for the first valve element is set so that the flow of the compensating volume through the overflow valve has as low losses as possible.

The fluid flowing in on the pressure-retaining side of the overflow valve only exits the interior of the valve when the valve side serving as the outlet allows the outflow into an adjacent piston chamber by the mechanical opening.

In the event of a pressure failure, the two valve elements move to the closed position due to the axial force applied by the spring elements so that the overflow valve closes on both valve sides.

The double-acting overflow valve of a working cylinder has the following in particular advantages.

An essential advantage is that, according to the invention, not only a pressure-dependent but also an adjustable control of the flow volume of the fluid is possible. This control is due to the interaction of the conical design of the valve tappets and the resulting adjustable width of the annular gap achieved by the adjustability of the maximum actuation path.

Another advantage in this respect is that dynamic pressures in the overflow valve are prevented. In order to minimize the dynamic pressure during the discharge of the compensation volume from the interior of the overflow valve, it is possible to determine the gap width on the outlet side, which corresponds to an appropriate axial displacement of the valve element on the outlet side and is required for the inflowing fluid volume. The width of the annular gap thus selected then provides a sufficiently large surface section in order to discharge the inflowing fluid volume over the outlet in a given time interval, as far as possible, without changing the flow velocity.

The advantage here is that, according to the invention, the maximum actuation paths of the first valve element and the second valve element can be set separately so that the two valve sides can be adapted to the requirements of the existing operating conditions via different opening degrees. Furthermore, the flow characteristic of the fluid can be determined by the degree of the conicity of the valve tappets.

In accordance with an advantageous further embodiment of the invention, the first and second actuating elements are designed as an exchangeable bush.

The exchangeable bushes are arranged on cylindrical support elements of the actuation path limiters, in particular they are plugged onto these and clamped so that they assume a fixed position and define a maximum actuation path for the valve elements by acting on the respective counter bearing. Exchangeable bushes with a longer axial extension lead to an earlier stop and thus to a shorter actuation path and consequently to a lower possible fluid flow rate. Conversely, exchange bushes with a smaller axial extension lead to a higher possible fluid flow rate.

According to a further preferred embodiment, the first and second actuating elements are designed as axially adjustable thread bushes.

Preferably, the thread bushes of the two actuation path limiters have an internal thread which is screwed onto the carrier elements provided with an external thread. Depending on the screw-in depth, a variable maximum actuation path and consequently a variable maximum fluid flow can be pre-determined.

Adaptation to different operating conditions is therefore particularly easy and moreover reversible. It is also possible to set different screw-in depths for the valve elements and thus different maximum actuation paths.

According to a next advantageous embodiment, the first and second valve tappets have a progressively conical shape starting from the respective valve tappet foot. The inclination of the surface of the valve tappet thus increases progressively in the direction of the valve tappet head.

As a result, the width of the respective annular gap and, accordingly, the fluid volume flowing in or out in a time interval can be varied in a progressive ratio. With the increase of the actuation path the fluid volume that can be overflowed per time unit does not increase linearly but progressively.

The subject of the present invention is, furthermore, a master cylinder which has a cylinder unit with closure parts and a piston unit. The piston unit forms a first and a second working chamber.

A characteristic feature of the master cylinder is that the piston unit has a double-acting overflow valve as described in the previous sections.

The double-acting overflow valve connects the first working chamber and the second working chamber and allows the control of the flow volume between them. In the master-slave arrangement, the working cylinders are hydraulically connected in such a manner that the piston rod chamber of the master cylinder is connected to the piston chamber of the slave cylinder.

The basic function of this coupling of two working cylinders is the simultaneous extension movement of the two piston rods so that the same extension paths are covered at the same times.

Since, however, flow losses occur in every system, this approach can only be adhered to if the losses are compensated. In this case, the double-acting overflow valve is the required intermediately connected functional unit.

For the design and operation of the double-acting overflow valve as a part of a master cylinder, see the explanations in the previous sections.

BRIEF DESCRIPTION OF THE SEVERAL VIEWS OF THE DRAWING

The invention is explained as an exemplary embodiment in more detail by means of FIG. 1 partially sectional view of the double-acting overflow valve FIG. 2 partially sectional view of the master cylinder with a double-acting overflow valve.

DESCRIPTION OF THE INVENTION

Figure 1:
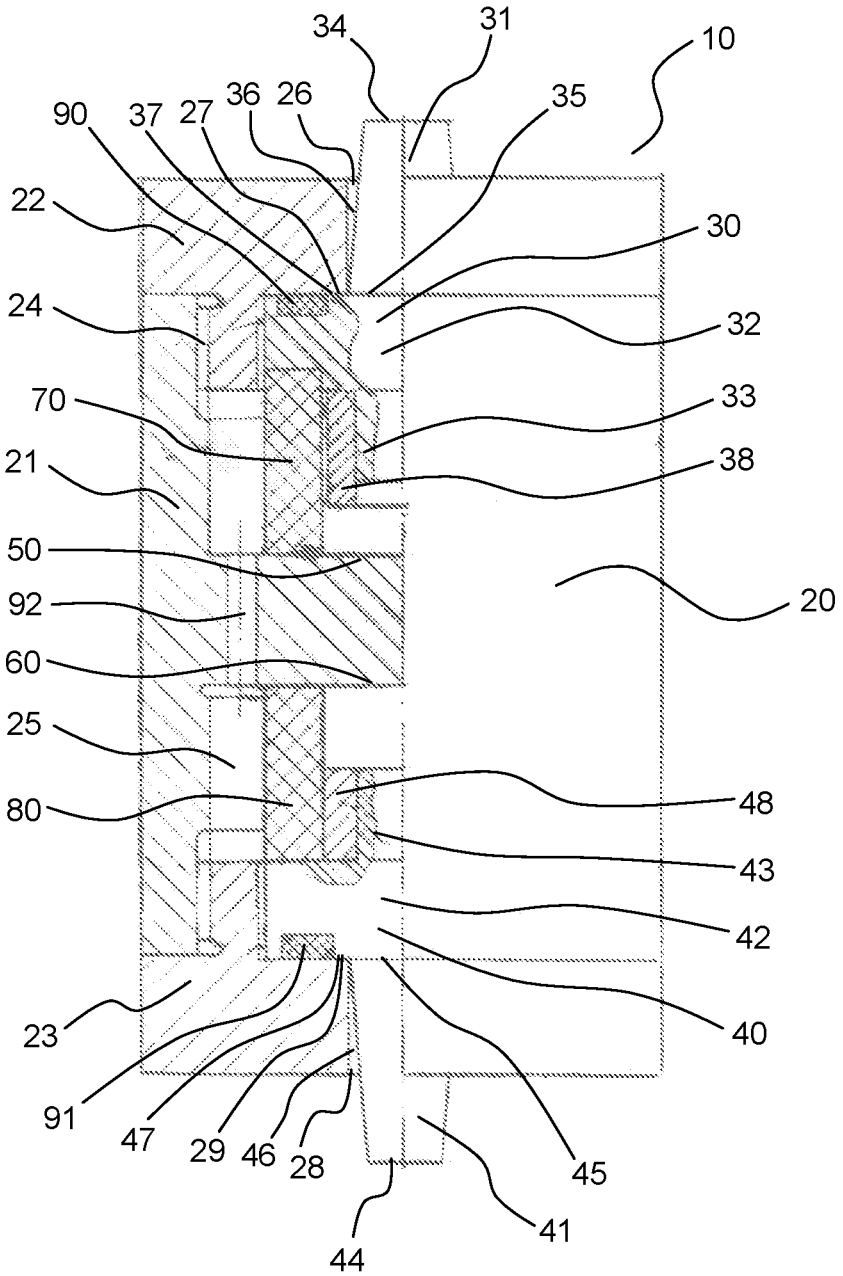

FIG. 1 shows an embodiment of the double-acting overflow valve 10 in a partially sectional view.

The overflow valve 10 has a housing 20, a first and a second valve body 30; 40, a first and a second counter bearing 50; 60 as well as a first and a second spring element 70; 80.

The housing 20 consists of an encompassing wall 21 and two axial delimiting walls 22; 23 positioned opposite one another, wherein in the embodiment the encompassing wall 21 is detachably connected to each of the delimiting walls 22; 23 by means of a pair of threads 24. Thus, an interior 25 is formed which is divided in two by a partition wall in the selected embodiment. The two sections of the interior 25 are connected by a duct 92, which passes through the partition wall so that a continuous flow of the fluid is made possible.

The two axial delimiting walls 22; 23 each have an axial bore 26; 28 and on the inside each form an annular valve bearing surface 27; 29 surrounding the axial bore.

In this embodiment, the first valve element 30 is designed in one piece and can be divided into a first valve tappet 31, a first valve disk 32 and a first actuation path limiter 33. The first valve tappet 31 has a first valve tappet head 34 and a first valve tappet foot 35 and passes through the first axial bore 26. According to the invention, the first valve tappet 31 is conical, wherein the diameter of the valve tappet 31 increases in the direction of the valve tappet foot 35.

In the open position, which can be assumed by an axial displacement of the first valve element 30 in the direction of the inner surface of the overflow valve 10, a first annular gap 36 is formed between the first valve tappet 31 and the first axial bore 26, the gap width of which is variable due to the conical shape of the first valve element 30 and is dependent on an actuation path of the first valve element 30.

The first valve disk 32 has a radial extension relative to the first valve tappet 31 so that a first axial annular surface is formed around the first valve tappet foot 35, and comes, in a closed position, into contact with the first annular valve bearing surface 27 and thereby forms a sealing plane. In addition, a sealing 90 is provided in the area of the first valve disk 32, which in the closed position is pressed against the first annular valve bearing surface 27 by the axial force of the first spring element 70 thus ensuring the seal.

The first actuation path limiter 33 is arranged on the first valve disk 32 axially opposite the first valve tappet 31 and has a first actuating element 38. A contact of the first actuating element 38 to the first counter bearing 50, which is formed by the diametrical connecting web of the encompassing wall 21 here, defines a maximum actuation path of the first valve element 30 according to the invention.

In the present case, the first actuating element 38 is designed as a thread bush, with the thread bush being provided with an internal thread and screwed onto a pin having an external thread. The adjustment of different maximum actuation paths and thus the width of the first annular gap 36 is then carried out via the screw-in depth of the thread bush.

In a modified exemplary embodiment, it is intended to design the first actuating element 38 as an exchangeable bush the axial length of which can be used for setting different maximum actuation paths. Depending on the desired overflow volume per time unit, it can be replaced by other exchangeable bushes of other axial lengths.

The previous explanations on the design and components of the first valve element 30 also apply to the second valve element 40 in this exemplary embodiment.

In order to apply an axial force to the first valve element 30 in the direction of the closed position, a first spring element 70 is provided. A corresponding second spring element 80 is provided for the second valve element 40. In the event of a pressure failure, the overflow valve 10 can be closed on both sides and a seal against the inflowing or outflowing fluid can be provided thanks to the axial resetting force. In the exemplary embodiment, the spring elements 70; 80 are designed as compression springs made of steel.

Figure 2:
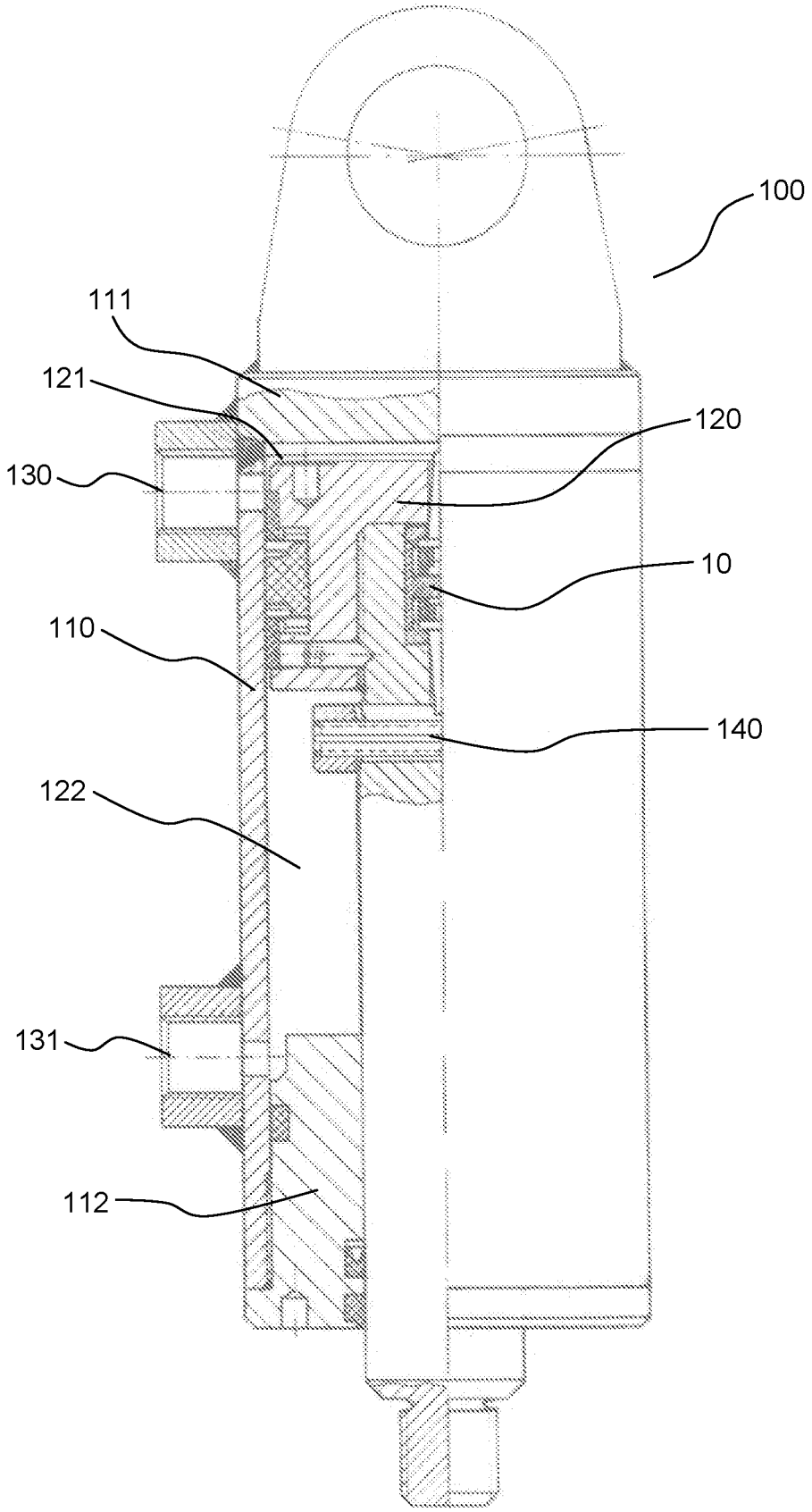

FIG. 2 shows a partially sectional view of a master cylinder 100 in the piston unit 120 of which a double-acting overflow valve 10 is installed according to the exemplary embodiment as shown in FIG. 1.

The master cylinder 100 is intended to be used in particular in a master-slave cylinder arrangement. It comprises a cylinder unit 110 with a bottom closure part 111 and a guide closure part 112 as well as a piston unit 120 consisting of a piston and a piston rod. The piston unit 120 forms a first working chamber 121 on the piston side and a second working chamber 122 on the piston rod side. Due to the fluid flow, the two working chambers 121; 122 are connected by the overflow valve 10.

A slave working cylinder (not shown here) can be connected with its piston side to a main connection 131 on the piston rod side via a supply line. According to the invention, the leakage losses occurring at the slave working cylinder can then be compensated by the overflow valve 10 installed in the piston unit 120 of the master cylinder 100. This compensation takes place when the adaptation part 140 acts on the inner wall of the guide closure part 112, which corresponds to a fully extended piston rod.

The piston rod side of the overflow valve 10 can thus be actuated by a mechanical force.

The operating pressure is applied via a main connection 130 on the piston side, and the piston side of the overflow valve 10 is opened via the prevailing hydraulic operating pressure. If the adaptation part 140 acts on the inner wall of the guide closure part 112, an open position of the piston rod side of the overflow valve 10 is provided by pressing in the valve tappet (in FIG. 2 without reference numeral) so that the fluid flowed in on the piston side can then flow out via the main connection 131 on the piston rod side into a working chamber of the slave working cylinder.

LIST OF REFERENCE NUMERALS

10 Overflow valve
20 Housing
21 Encompassing wall
22 First delimiting wall
23 Second delimiting wall
24 Thread pair
25 Interior
26 First axial bore
27 First annular valve bearing surface
28 Second axial bore
29 Second annular valve bearing surface
30 First valve element
31 First valve tappet
32 First valve disk
33 First actuation path limiter
34 First valve tappet head
35 First valve tappet foot
36 First annular gap
37 First axial annular surface
38 First actuating element
40 Second valve element
41 Second valve tappet
42 Second valve disk
43 Second actuation path limiter
44 Second valve tappet head
45 Second valve tappet foot
46 Second annular gap
47 Second axial annular surface
48 Second actuating element
50 First counter bearing
60 Second counter bearing
70 First spring element
80 Second spring element
90 Sealing of the first valve disk
91 Sealing of the second valve disk
92 Duct
100 Master cylinder
110 Cylinder unit
111 Bottom closure part
112 Guide closure part
120 Piston unit
121 First working chamber
122 Second working chamber
130 Main connection on the piston side
131 Main connection on the piston rod side
140 Adaption part

The invention claimed is:

1. A double-acting overflow valve of a working cylinder, comprising:

a housing having an encompassing wall and a first delimiting wall and a second axial delimiting wall being arranged opposite one another, said encompassing wall and said delimiting walls defining an interior, said first axial delimiting wall having a first axial bore and defining a first annular valve bearing surface surrounding said first axial bore on an inner side of said first axial delimiting wall, and said second axial delimiting wall having a second axial bore and defining a second annular valve bearing surface surrounding said second axial bore on an inner side of said second axial delimiting wall;

a first valve body and a second valve body;

said first valve body having a first valve tappet, a first valve disk and a first actuation path limiter, said first valve tappet having a first valve tappet head and a first valve tappet foot;

said first valve tappet resting on said first valve disk with said first valve tappet foot, said first valve tappet having a conical shape and passing through said first axial bore, and in an open position said first valve tappet and said first axial bore defining a first annular gap therebetween, a gap width of said first annular gap being dependent on a position of said first valve body along an actuation path thereof;

said first valve disk having a first axial annular surface surrounding said first valve tappet foot, said first axial annular surface and said first annular valve bearing surface defining a sealing plane in a closed position of said first valve disk, said first actuation path limiter resting on said first valve disk, said first valve tappet and said first actuation path limiter being arranged axially opposite each another;

said second valve body having a second valve tappet, a second valve disk and a second actuation path limiter, said second valve tappet having a second valve tappet head and a second valve tappet foot;

said second valve tappet resting on said second valve disk with said second valve tappet foot, said second valve tappet having a conical shape and passing through said second axial bore and, in an open position, said second valve tappet and said second axial bore defining a second annular gap therebetween, a gap width of said second annular gap being dependent on a position of said second valve body along an actuation path thereof;

said second valve disk having a second axial annular surface surrounding said second valve tappet foot, said second axial annular surface and said second annular valve bearing surface defining a sealing plane in a closed position of said second valve disk, said second actuation path limiter resting on said second valve disk, said second valve tappet and said second actuation path limiter being arranged axially opposite each another;

a first counter bearing and a second counter bearing;

said first actuation path limiter having a first actuating element and said first actuating element defining a maximum actuation path of said first valve body by acting on said first counter bearing;

said second actuation path limiter having a second actuating element, and said second actuating element defining a maximum actuation path of said second valve body by acting on said second counter bearing;

a first spring and a second spring, said first spring applying an axial force to said first valve body in a direction of said closed position of said first valve disk and said second spring applying an axial force to said second valve body in a direction of said closed position of said second valve disk.

2. The double-acting overflow valve of a working cylinder according to claim 1, wherein said first or second actuating element is constructed as an exchangeable bush.

3. The double-acting overflow valve of a working cylinder according to claim 1, wherein said first or second actuating element is constructed as an axially adjustable threaded bush.

4. The double-acting overflow valve of a working cylinder according to according to claim 1, wherein said first or second valve tappet has a progressively conical shape starting from said first or second valve tappet foot.

5. A master cylinder, comprising:

a cylinder unit with closure parts and a piston unit, said piston unit defining a first and a second working chamber;

said piston unit having a double-acting overflow valve according to claim 1 connecting said first and said second working chamber to one another.

* * * * *